United States Patent [19]

Schroeder

[11] 4,224,137

[45] Sep. 23, 1980

[54] RECOVERY OF CATALYSTS FROM THE HYDROGENATION OF COAL

[76] Inventor: Wilburn C. Schroeder, 7316 Radcliffe Dr., College Park, Md. 20740

[21] Appl. No.: 931,285

[22] Filed: Aug. 4, 1978

[51] Int. Cl.[2] ..... C10G 1/06; B01J 37/00; B01J 37/12; C01G 45/00

[52] U.S. Cl. ..... 208/10; 252/415; 252/416; 423/49; 423/60; 423/149

[58] Field of Search ..... 208/10; 252/415, 416; 423/60, 149, 49

[56] References Cited

U.S. PATENT DOCUMENTS

| | | | |
|---|---|---|---|
| 2,733,983 | 2/1956 | Daubenspeck | 423/149 |
| 2,756,194 | 7/1956 | Nayland | 208/10 |
| 2,985,507 | 5/1961 | Wienert | 423/60 X |
| 3,539,290 | 11/1970 | Erickson et al. | 252/415 X |
| 3,625,861 | 12/1971 | Gorin | 252/416 |
| 3,729,407 | 4/1973 | Camp et al. | 208/10 |

*Primary Examiner*—Delbert E. Gantz
*Assistant Examiner*—William G. Wright
*Attorney, Agent, or Firm*—Jesse B. Grove, Jr.

[57] ABSTRACT

Coal hydrogenation catalyst is recovered from coal hydrogenation residues containing carbonaceous matter, coal ash and catalyst by contacting such residues with oxygen and steam under conditions to provide $H_2$ and CO containing gases and fused ash which contains catalyst, contacting the fused ash with a reactant which will react with the catalyst to form a catalyst compound which is volatile at the temperature of the fused ash and withdrawing vaporized catalyst compound from the fused ash. The vaporized catalyst may be condensed and dissolved in a solvent liquid to form a solution of catalyst for application to coal to be hydrogenated.

10 Claims, 1 Drawing Figure

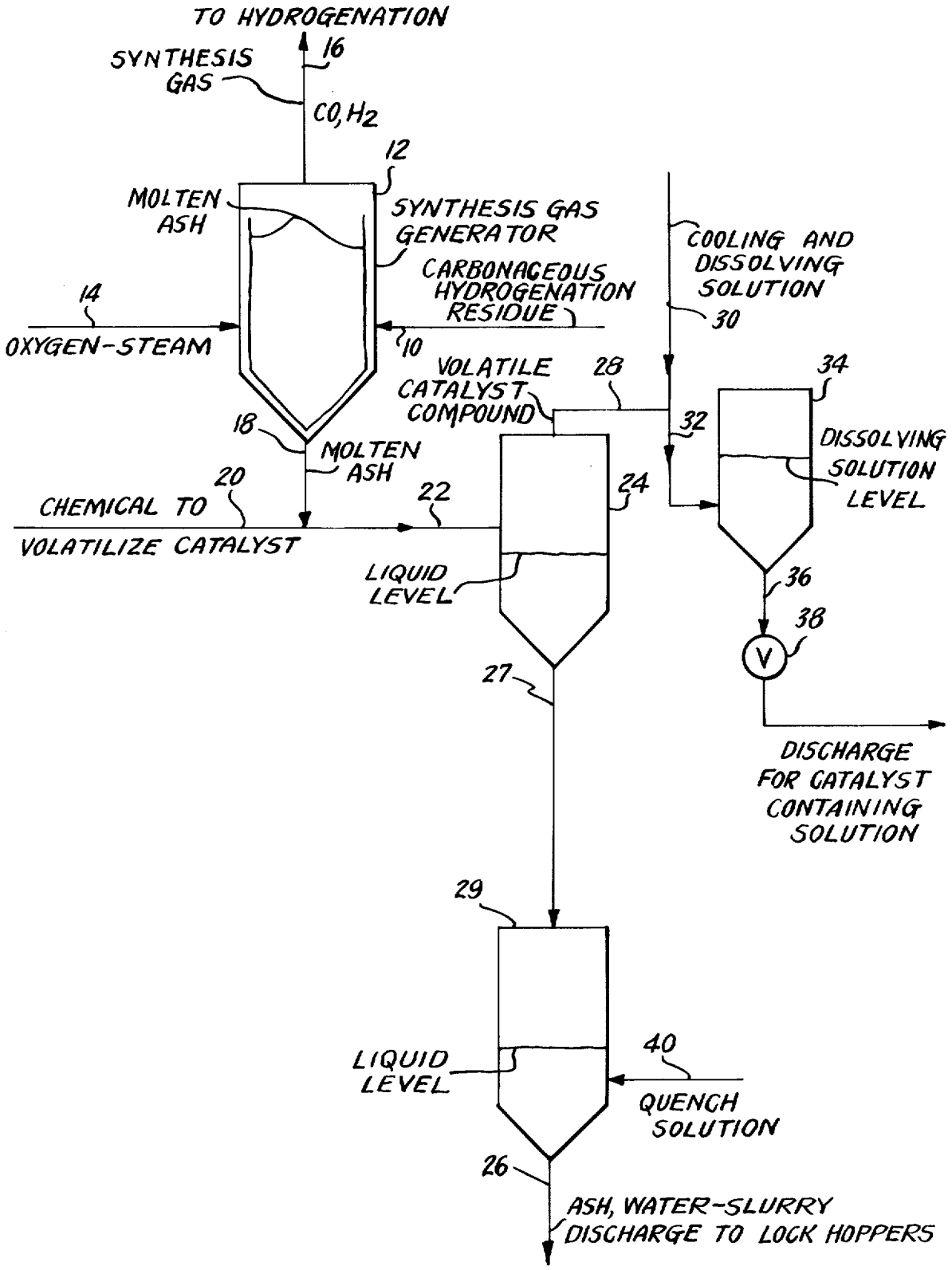
TO HYDROGENATION
16
SYNTHESIS GAS
CO, H2
12
MOLTEN ASH
SYNTHESIS GAS GENERATOR
COOLING AND DISSOLVING SOLUTION
CARBONACEOUS HYDROGENATION RESIDUE
14
30
OXYGEN-STEAM
10
VOLATILE CATALYST COMPOUND
28
34
32
18
MOLTEN ASH
DISSOLVING SOLUTION LEVEL
20
22
24
CHEMICAL TO VOLATILIZE CATALYST
LIQUID LEVEL
36
38
V
27
DISCHARGE FOR CATALYST CONTAINING SOLUTION
29
LIQUID LEVEL
40
QUENCH SOLUTION
26
ASH, WATER-SLURRY DISCHARGE TO LOCK HOPPERS

RECOVERY OF CATALYSTS FROM THE HYDROGENATION OF COAL

BACKGROUND OF THE INVENTION

Numerous metals or metallic compounds catalyze the hydrogenation of coal to liquids and gases. These materials are especially effective in promoting the conversion of coal to liquids during hydrogenation at temperatures in the range from 850° to 1050° F. in the absence of a pasting oil. At higher temperatures hydrocarbon liquids which are formed tend to be rapidly cracked to gases.

It should be noted, however, that catalysts may be used effectively in processes in which the major product is a high-Btu gas, such as intended for pipeline transmission. The presence of the catalyst is effective in converting the coal in the hydrogenation reactor primarily to methane and ethane. Operating temperatures in the reactor to produce methane and ethane will generally be in the range from 1050° to 1350° F.

The catalysts for oil or gas production are most effective when they are well dispersed so that the catalyst, coal particle and hydrogen are in simultaneous juxtaposition. This promotes the formation of dissociated hydrogen at the location where it is most effective in hydrogenating the coal to liquid or gas.

Various methods are used to secure uniform dispersion of the catalyst on the coal particles and in fact to have the catalyst penetrate the interstices of the coal particle insofar as possible. These include dissolving or dispersing the catalyst in a liquid in which the crushed or pulverized coal is then immersed. Dissolved catalyst may also be sprayed on crushed coal, the coal then being pulverized to obtain good distribution Metals which are known to form effective catalytic compounds include cobalt, iron, manganese, molybdenum and nickle. Some may be used in the metal form but are more frequently used as oxides, sulfides, or chlorides which may be soluble in water or chemical solutions.

Efficient catalyst recovery is particularly essential for hydrogenation processes using catalytic compounds of such relatively expensive metals as cobalt, molybdenum or nickel. For example, it is desirable to have approximately 1 weight percent molybdenum present during the hydrogenation of pulverized coal. At present prices for molybdenum compounds, 96 percent of this metal must be recovered and recycled to hold catalyst makeup costs to approximately $1.00 per barrel of oil equivalent produced.

In coal hydrogenation processes, gases and light oil vapors may easily be separated from a carbonaceous residue containing heavy oils-tars, unreacted coal and carbon, as well as ash. The majority of the metallic compounds used as catalysts revert to solids under hydrogenation conditions and remain with the carbonaceous residue. Accordingly, if the carbonaceous residue containing ash is sent to a synthesis gas generator to produce $H_2$ and CO for the process, the catalyst also goes to the synthesis gas generator.

The direct recovery of molybdenum catalyst by vaporization of molybdenum oxide in a synthesis gas generator has been suggested (U.S. Pat. No. 3,729,407, Apr. 24, 1973, Frederick W. Camp et al). However, under conditions existing in a synthesis gas generator, i.e. high pressures of hydrogen and CO at a temperature of 1500° F. to 3000° F., essentially all of the molybdenum oxide would be reduced to the metal, which has a melting point of 4740° F., and the metal would not be present as a vapor. It is evident that most of the metal would be entrapped in the ash and would leave the synthesis gas generator with the ash, and therefore the method of catalyst recovery suggested in this patent is not very effective for molybdenum compound recovery.

SUMMARY OF THE INVENTION

The purpose of this invention is to provide a simple and practical method for essentially complete recovery of the catalyst from the ash remaining after reaction of carbonaceous, hydrogenation residues in a synthesis gas generator, so that the catalyst may be recycled to the hydrogenation process. This is done by operating the synthesis gas generator under conditions to provide molten ash containing the catalyst and treating the molten ash after it leaves the synthesis gas generator with chemical materials which convert the catalyst to compounds which are volatile at the ash fusion temperature so that the catalyst compound is volatilized and may be readily separated from the molten ash and recovered.

The present invention substantially eliminates catalyst loss from the synthesis gas generator. The process set forth in this invention makes it possible to recycle as much as 96% of the catalyst, and operated under conditions specified, may often achieve catalyst recovery well in excess of 96%.

DETAILS OF THE INVENTION

The catalyst recovery method of this invention may be applied to any catalytic hydrogenation process in which a carbonaceous residue containing ash and catalyst is obtained after separation of the desired products. Illustrative coal hydrogenation processes with which the invention may be employed are disclosed in Schroeder et al U.S. Pat. No. 3,152,063, Schroeder U.S. Pat. Nos. 3,823,084, 3,926,775, 3,944,480, 3,954,596 and 3,960,701 and the patent to Camp et al U.S. Pat. No. 3,729,407, the disclosures of which are herein incorporated by reference.

The carbonaceous residue from such a process, containing ash and hydrogenation catalyst, is fed to a synthesis gas generator and is reacted with steam and oxygen at a temperature above the fusion temperature of the ash to provide synthesis gases and molten ash containing the catalyst. The molten ash, after withdrawal from the reactor, is contacted with a chemical which will form a catalyst compound which is volatile at the temperature of the molten ash and which is separated from the ash and then condensed and recovered.

The application of this method of catalyst recycle is dependent on the particular metal or mixture of metals being used as catalysts and the properties of their various chemical compounds, particularly the chlorides, fluorides, oxides and sulfides. The melting, boiling and sublimation temperatures of some of the major catalytic materials or compounds are shown in Table 1.

TABLE 1

| Metal or Compound | °F (Approximate) Melting Point | Boiling Point | Sublimation Temperature |
|---|---|---|---|
| COBALT | 2723 | Very high | -- |
| chloride | 1335 | 1920 | -- |
| fluoride | 2190 | 2550 | -- |
| oxide | 3500 | -- | -- |
| sulfide | >2040 | -- | -- |
| IRON | 2800 | 5400 | -- |
| chloride | 1240 | -- | 1240 |
| sulfide | 3220 | Very high | -- |
| MANGANESE | 2230 | -- | -- |
| chloride | 1200 | 2174 | -- |
| fluoride | 1570 | -- | -- |
| oxide | 3000 | -- | -- |
| sulfide | decomposes | -- | -- |
| MOLYBDENUM | 4750 | Very high | |
| chloride | 380 | 514 | |
| fluoride | 64 | 95 | |
| oxide (tri) | 1460 | -- | 2110 |
| sulfide (di) | 2165 | -- | -- |
| NICKEL | 2650 | 4900 | -- |
| chloride | -- | -- | 1783 |
| fluoride | -- | -- | 1830 |
| oxide | 1990 | Very high | -- |
| sulfide | -- | -- | 1460 |

In the hydrogenation reaction at temperatures above approximately 850° F., e.g. 850°-1250° F., under high hydrogen presure, e.g. 500—5000 psi, and in the presence of steam, these metals exist mainly as oxides or sulfides (from the sulfur in the coal) and to a slight extent as the metal. Since the resulting materials are all solids they will remain with the carbonaceous residue, e.g. the heavy oil-tars and ash removed from the hydrogenation reactor or any subsequent distillation or vaporization steps which are involved. When this residue is used to produce synthesis gas, it is preferably heated to temperatures above 2400° F. in a high pressure reducing atmosphere consisting mainly of $H_2$ and CO, which will rapidly reduce the catalytic oxides and sulfides to metals, which in turn will leave the synthesis gas generator with molten ash. A preferred method of operating the synthesis gas generator to obtain rapid reaction and effective separation of molten ash from generated gases is disclosed in my copending application Ser. No. 931,286 filed Aug. 4, 1978 concurrently herewith.

The invention will be further described in conjunction with the accompanying flow sheet drawing. Referring now to the drawing, carbonaceous residue, from a hydrogenation process, containing ash and catalyst is introduced by way of line 10 into synthesis gas generator 12. Preferably, the carbonaceous residue is pumpable and may contain heavy oils and tars, unreacted coal and carbon as well as ash and catalyst. Where the hydrogenation process is operated primarily for the production of pipeline gas, it may be operated under conditions just sufficient to provide enough heavy oil to remove ash from the gas, facilitate pumping of the ash and catalyst to the synthesis gas generator and supply the material to generate to hydrogen requirement for the process.

Oxygen and steam are introduced into the generator 12 by means of line 14.

As described in aforementioned accompanying patent application of Ser. No. 931,286 filed Aug. 4, 1978, the carbonaceous residue, oxygen and steam are preferably introduced tangentially at high velocity, e.g. above 5 feet per second. It should be noted that generator 12 operates at pressures slightly above that used in the coal hydrogenation process and at temperatures above the fusion temperature of the ash in the coal. Preferred operating temperatures are above 2400° F., e.g. 2400° to 3100° F., and pressures are usually in the range of 500 to 5000 psi.

Under these conditions the carbonaceous components of the residue are quickly converted to $H_2$ and CO and these gases pass overhead through line 16 to supply hydrogen for the hydrogenation reaction.

Molten ash collects at the bottom of generator 12 and is withdrawn through line 18. A suitable gas or chemical is introduced through line 20 and mixes with the molten ash in line 22. The mixture passes through line 22 into vessel 24 wherein the catalyst compound is volatilized. The molten ash, devoid of catalyst, flows through line 27 to vessel 29 where the molten ash falls into water at the bottom of this vessel to form a water-ash slurry. This additional vessel is preferred as it provides longer reaction times for catalyst volatilization in vessel 24. The slurry is withdrawn through line 26 and lock-hoppers which are not shown.

The volatile catalyst compound leaves vessel 24 through line 28 and joins a cooling and dissolving solution which is introduced through line 30. This condenses and dissolves the catalyst compound which flows through line 32 into vessel 34. From this vessel the solution containing the catalyst is discharged through line 36 and pressure reducing valve 38.

The gas or chemical (usually gas) selected to volatize catalysts such as those shown in Table 1 must produce a compound by reaction with the catalyst which boils or sublimes well below 2400° F. (or below the temperature at which the synthesis gas generator is operated). For molybdenum, cobalt, iron, manganese and nickel, as shown in Table 1, this may be chlorine gas. For molybdenum, oxygen is also satisfactory. For nickel, fluorine or sulfur may also be used.

It should be noted that any catalyst particles entrained in the gas stream leaving through line 16 are not lost from the system, since this stream may be used to heat the incoming coal and the catalyst will therefore be mixed with the coal and recycled to the process.

Hydrogenation processes are frequently catalyzed by using a combination of metallic compounds. A typical example is the use of a mixture of cobalt and molybdenum compounds. In such a case, two gases may be introduced through line 20 to facilitate the conversion of the cobalt and the molybdenum to volatile materials. For example, gas containing both chlorine and oxygen may be introduced. Chlorine is required for the cobalt and oxygen as well as chlorine will react with molybdenum to provide the desired volatile compounds. It is intended therefore that a combination of gases may be introduced through line 20 to volatilize the catalysts that are present.

The cooling and dissolving solution introduced through line 30 and be water or an acid or alkaline solution such as sulfuric acid or sodium carbonate, depending on the particular catalyst compound or compounds which are being produced. For example, cobalt and nickel chlorides are soluble in water and this could be used as the cooling and dissolving solution when these compounds are present Molybdenum oxide $MoO_3$ is soluble in an ammonium hydroxide solution and this may be used for the cooling and dissolving solution for this catalyst.

In recycling the catalyst solution to be used to impregnate fresh coal, it may be used in the concentration in which it is discharged from vessel 34 or the solution may be concentrated by evaporation of some of the water to produce a higher concentration of the catalyst.

The hot ash, devoid of gases, which passes from vessel 24 through line 27 to vessel 29, may be chilled or quenched in water, as shown, or a solution may be used which will act as a solvent for any catalyst compounds which still remain in the ash. In the case of molybdenum oxide the quench water may contain ammonia to assist in the complete recovery of the catalyst. The slurry solution of ash and catalyst is then discharged from vessel 29 as shown, and the ash separated from the solution by settling, centrifuging or filtration. The catalyst may then be recovered from the clarified solution by precipitation and filtration or other chemical and physical means. The remaining solution can be cooled, additional catalyst solvent added if necessary, and the solution recycled to vessel 29 through line 40 to form further slurry with the ash.

The process disclosed in this invention is not intended to be limited to the catalyst metals or combination of metals shown in Table 1. These materials are representative only of the application of the inventive concepts. Other metals which are suitable hydrogenation catalysts may also be recovered from the ash by the method shown, so long as they can be reacted with chemicals that form volatile chemical compounds at or above the melting temperature of the ash, to the maximum temperature that can be reached in the synthesis gas generator. In general, this maximum is about 3100° to 3200° F.

While the invention has now been described in terms of various preferred process parameters, and exemplified with respect thereto, the skilled artisan will appreciate that various substitutions, changes, omissions, and modifications may be made without departing from the spirit thereof. Accordingly, it is intended that the scope of the invention be limited solely by that of the following claims.

I claim:

1. A method for recovering hydrogenation catalyst from a carbonaceous, coal hydrogenation residue containing same along with coal ash, said catalyst comprising a compound of a metal having a volatilization temperature above the fusion temperature of coal ash, comprising introducing said residue into a synthesis gas generator operated at a temperature in the range of about 2400° F. to 3100° F. and in excess of the fusion temperature of the coal ash to provide hydrogen containing gases and molten ash containing catalyst at least in part in metallic form, withdrawing said molten ash from the synthesis gas generator, contacting said withdrawn molten ash with a chemical reactant which will form a compound with said metallic catalyst which compound has a volatilization temperature below the temperature of the molten ash, withdrawing volatilized catalyst compound from said ash and removing said compound for reuse.

2. The method of claim 1 wherein the volatilized catalyst compound is recovered by introducing it into a solvent for such compound.

3. The method of claim 1 wherein the molten ash is quenched after withdrawal of volatile catalyst compound and catalyst compound remaining in the ash is removed by treatment of the ash with a solvent for said catalyst compound.

4. The process of claim 1 wherein the hydrogenation catalyst is selected from the group consisting of cobalt, iron, nickel, manganese and molybdenum, compounds of said metals, and mixtures of said substances.

5. The process of claim 1 wherein the hydrogenation catalyst is molybdenum, a molybdenum compound or a mixture of the metal and a compound thereof, the reactant with which the withdrawn molten ash is contacted is oxygen, and the volatilized catalyst is in the form of an oxide.

6. The process of claim 3 wherein the reactant with which the molten ash is contacted is chlorine gas, and the volatilized catalyst is in the form of a chloride.

7. The process of claim 6 in which the volatilized metallic chloride catalyst is condensed and dissolved in water.

8. The process of claim 5 in which the volatilized oxide of molybdenum is condensed and dissolved in an aqueous solution of ammonium hydroxide.

9. In a continuous coal hydrogenation process wherein coal is hydrogenated by hydrogen-containing gases in the presence of a hydrogenation catalyst which is carried out of the hydrogenation vessel with the effluent stream and is contained in the carbonaceous residue remaining after separation of hydrocarbon products and wherein the catalyst comprises a compound of a metal having a volatization temperature above that of the fusion temperature of coal ash, the improvement comprising reacting said carbonaceous residue with steam and oxygen in a synthesis gas generator in which the temperature is about 2400° F. to 3100° F. to provide hot hydrogen-containing gases for the hydrogenation reaction and molten ash containing at least a portion of said catalyst in metallic form, removing said molten ash from the synthesis generator, contacting said withdrawn molten ash with a chemical reactant which will form a compound with said metallic catalyst which compound has a volatilization temperature below the temperature of the molten ash, withdrawing volatilized catalyst compound from said ash and recovering said compound for reuse in the hydrogenation process.

10. The process of claim 9, wherein the hydrogenation catalyst comprises a molybdenum compound, the reactant with which the molten ash is contacted comprises oxygen, the vaporized molybdenum oxide is condensed and dissolved in an aqueous solution of ammonium hydroxide and the resulting solution is used to catalyze coal for hydrogenation.

* * * * *